United States Patent [19]

Jensen et al.

[11] 4,193,241

[45] Mar. 18, 1980

[54] MASONRY BLOCK INSULATING DEVICE

[76] Inventors: Knud Jensen, 2929 E. Stewart Ave., Apt. 3, Las Vegas, Nev. 89101; Ralph F. Cooper, 5251 New Bedford Cir., Las Vegas, Nev. 89122

[21] Appl. No.: 857,202

[22] Filed: Dec. 5, 1977

[51] Int. Cl.[2] ..... E04C 1/06

[52] U.S. Cl. ..... 52/405; 52/309.12; 52/577; 52/747; 52/125

[58] Field of Search ..... 52/405, 576, 577, 309.4, 52/309.12, 309.8, 747, 125

[56] References Cited

U.S. PATENT DOCUMENTS 3,546,833 12/1970 Perreton ..... 52/405

4,027,445 6/1977 Nickerson ..... 52/405

FOREIGN PATENT DOCUMENTS 967776 5/1975 Canada ..... 52/405

2440466 3/1976 Fed. Rep. of Germany ..... 52/405

*Primary Examiner*—James A. Leppink

*Assistant Examiner*—Henry E. Raduazo

*Attorney, Agent, or Firm*—Seiler & Quirk

[57] ABSTRACT

A device for insulating masonry block comprises an insulating plug member for being inserted into a cinder block space, the plug member having a protruding portion extending outwardly from the block, and a cavity extending inwardly along a side of the plug member.

5 Claims, 9 Drawing Figures

MASONRY BLOCK INSULATING DEVICE

BACKGROUND OF THE INVENTION

Masonry block, including slump stone and cinder block, having hollows or spaces therein, are widely used construction materials. Such masonry blocks are especially useful in constructing exterior building walls, with the blocks normally staggered or offset to one another as they are stacked by the mason with mortar between each block to form a mortar joint. A wall so constructed out of the masonry block is hollow, since the cinder block is of the type which normally has a pair of rather large spaces defined by the interior sides of the cinder block composition walls. Insulation of such walls becomes increasingly important as energy and heating costs spiral. Heretofore, it has been common to attempt to so insulate the walls by blowing an insulating material, in the form of rock wool, glass fiber compositions, or foamed plastics into the block spaces. However, such a method is not altogether satisfactory, since the materials must be directed into the walls from the top, and because the blocks are offset and staggered from one another, the spaces are usually incompletely filled, thereby leaving significant voids which reduce the overall effectiveness of the insulation.

SUMMARY OF THE INVENTION

The present invention is directed to an insulating device for masonry or cinder block comprising an insulating plug which is inserted into the masonry block space prior to or at the time of wall construction. The insulating plug has a shape so that it substantially fills a hollow masonry block space. The insulating device also includes an integral protruding portion which extends outwardly from one of the exposed insulating plug ends. The protruding portion acts as a spacer for assisting the mason in creating a suitable mortar joint when constructing the wall, and also fills a substantial portion of the void created by the mortar joint. The insulating plug also includes a cavity, preferably at the opposite end from the protruding member, which assists in allowing a mason to consistently handle a cinder block having the insulating plugs inserted in the cinder blocks bases.

DETAILED DESCRIPTION OF THE INVENTION

Figure 1:
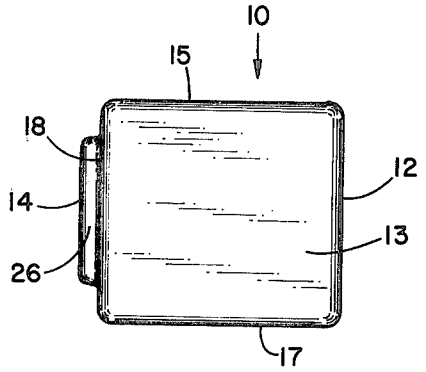
FIG. 1 is a side view of the insulating device of the invention.
Figure 2:
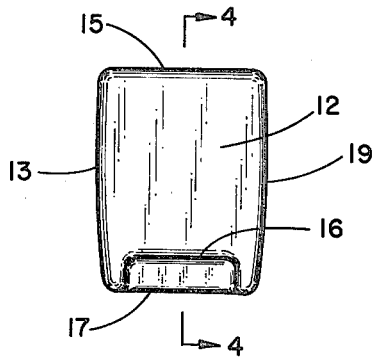
FIG. 2 is an end view thereof.
Figure 3:
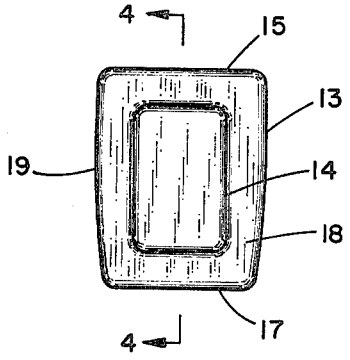
FIG. 3 is an end view of the opposite end thereof.

The insulating device of the invention is shown elevationally in FIGS. 1–3. The device illustrated may have any suitable exterior shape for being inserted into and substantially filling a space in a masonry block such as a cinder block, slump stone block, adobe block or the like. In the embodiment shown, insulating devices are of a shape for filling a cinder block space having a rectangular or square shaped side wall surface. Accordingly, the insulating device 10 has four sides 13, 15, 17 and 19 which are contiguous and form a rectangularly shaped plug member for being inserted into a cinder block space having substantially the same shape and size. In other words, the dimensions of the rectangular cross-sectional shape of the four sides as shown in FIGS. 2 and 3 will be such that the device can be readily inserted into a masonry block space without requiring undue pressure, but preferably not so loose that the device will slip out under its own weight.

Figure 7:
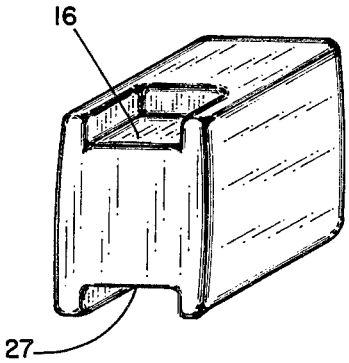
FIG. 7 shows an alternative device embodiment incorporating two cavities.
Figure 9:
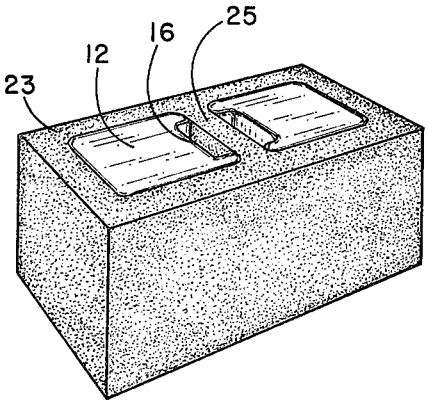
FIG. 9 is a view a masonry block showing the opposite ends of the insulating devices from that shown in FIG. 8.

The insulating device of the invention comprises a plug member defined between ends 12 and 18 which is substantially solid except for a cavity 16 formed at one end and along one side. Thus, cavity 16 extends inwardly from one of the ends, preferably end 12, which is opposite end 18 from which integral protruding portion 14 extends. The cavity extends along one of the sides, side 17 being shown in the illustrations. The purpose of the cavity 16 is best illustrated in FIG. 9 where it is located adjacent a center divider (25) of the cinder block. In such a position, the cavity allows a person to readily grip and pick up the cinder block with one hand with the fingers extending into cavity 16 and the thumb into the plug cavity on the opposite side of the divider. The depth of the cavity should be such that one's fingers can extend sufficiently therein to readily grasp and carry the cinder block, without forcing or dislodging the insulating device from its position in the space. Of course, if desired, the plugs could be so placed in the block so that it could be picked up from the block end instead. Moreover, the plug may be alternatively produced with two opposite 16 and 27 formed as shown in FIG. 7, so that the block can be picked up from the end or the divider.

Figure 4:
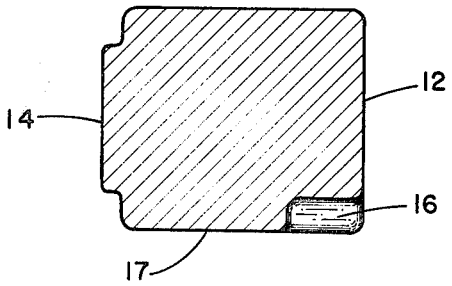
FIG. 4 is a side sectional view of the device taken along lines 4—4 of FIGS. 2 and 3.

On one of the insulating device ends is a protruding portion 14. This portion is integral with the plug member as illustrated in FIG. 4, and preferably extends outwardly from end surface 18, opposite end 12 in which cavity 16 is formed. The purpose for the protruding portion is to provide a standoff or space between masonry blocks sufficient for a mortar joint. Accordingly, the distance between the protruding portion end surface and plug end wall 18, i.e., the height of protruding portion wall 26, is approximately that of a mortar joint thickness, which corresponds to the distance between adjacent blocks. The protruding portion also serves the additional and important function of filling a substantial portion of the space between blocks caused by the mortar joint. The cross-sectional shape of the protruding portion is not critical so long as it fills a substantial portion of the space between the cinder blocks which have not been filled by the mortar of the mortar joint. The end surface of the protruding portion is preferably flattened as shown in FIGS. 1, 4, 5 and 8 so as to lie against the flat end surface 12 of the next adjacent or successive insulating device. Thus, as a block wall is constructed, with the successive cinder blocks stacked on top of one another, and separated and secured by a mortar joint, they are normally staggered so that the end of the next lower and higher block are aligned at approximately the center of the intermediate block. A flat end surface of a protruding portion will conveniently lie against the opposite end of an adjacent and successive insulating device, and at the same time, yield a maximum cross-sectional dimension for taking up a substantial space between blocks.

Figure 6:
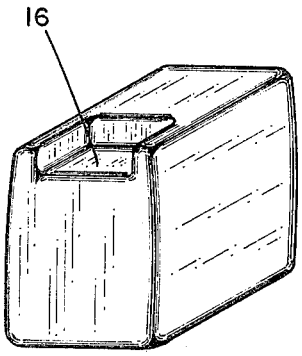
FIGS. 5 and 6 are perspective views illustrating opposite ends of the insulating device.
Figure 5:
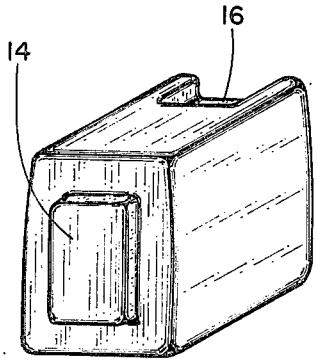
Figure 8:
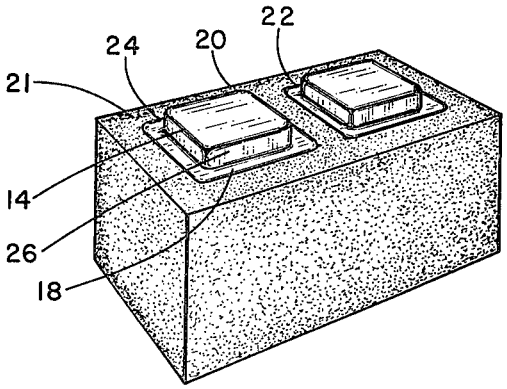
FIG. 8 is a perspective view showing the insulating devices inserted in a masonry block.

FIGS. 8 and 9 illustrate the preferred positioning of the insulating devices of the invention in two spaces 22 and 24 within cinder block 20. The spaces are generally rectangular, formed by the interior walls of the hollow cinder block, and the insulating device illustrated in FIGS. 5 and 6 will conveniently fit within such spaces. The devices are inserted so that projecting portions 14 of both of the devices extend in the same direction outwardly from the cinder block. Moreover, the size of the insulating device is such that when inserted and properly positioned within a block space, one end wall 18 will be substantially flush with cinder block surface 21, while the opposite insulating device end 12 is substantially flush or even with cinder block surface 23. In other words, the length of sides 15 and 17 of the plug members illustrated in FIGS. 1–3 are approximately equal to the length of the interior sides of the cinder block which define the space. Such dimensions allow the insulating device to substantially fill the entire cinder block spaces except for the relatively small cavity 16, provided for the convenience of a mason in handling a block with the insulating device inserted.

The insulating device may be produced from any suitable insulating composition, preferably one that can be relatively easily molded, cut or otherwise formed. Foamed plastics from which such an insulating device may be readily made include ABS (acrylonitrile-butadiene-styrene), cellulose acetate, epoxy resins, phenolics, polyethylene (low density foam), polystyrene (Styrofoam brand expanded cellular polystyrene), polyurethane, and polyvinyl chloride. Of course, costs will vary significantly between such compositions, and economical product selection is desirable, so long as the required insulation effect is achieved. Normally, preferred insulating compositions used are those foamed synthetic resins having a thermal conductivity of less than about 1.0 Btu/sq. ft./hr./°F./in., according to ASTM D2326 or ASTM C177 (polystyrene). Preferred compositions meeting such specifications have thermal conductivities below about 0.50 with extremely good insulation being that below about 0.30.

As previously noted, size and dimensional requirements of the insulating devices will depend on the specific shape and size of the spaces within the masonry blocks to be insulated. Some cinder blocks have openings which are rectangular, having nominal dimensions of about $6'' \times 3\frac{1}{2}'' \times 5\frac{1}{2}''$ depth, while other such blocks have nominal openings of $5\frac{1}{2}'' \times 7\frac{1}{2}''$. Normally, mortar joints are nominally between about $\frac{1}{4}$ and about $\frac{1}{2}''$, so that the height of the protruding portion will be approximately that length. Again, however, selection of any suitable size and shape of insulating device may be made to achieve the desired purpose as may the selection of any desirable and suitable composition within the scope hereof.

I claim:

1. A method of forming a cinder block wall comprising the steps:

(1) forming insulating plug members, each having a generally rectangular cross-section with first and second opposite flat end walls and four side walls, and an integral protruding portion having a height equal to the height of a mortar joint extending outwardly from the first one of said flat end walls and said protruding portion having a substantially flat end surface capable of being moved in any lateral direction against the second flat end wall of an adjacent plug member when said wall is being formed to permit truing up the outer surface of the side wall, said protruding portion having a cross-sectional dimension so as to fill a substantial portion of the space between adjacent insulating plug members, (2) inserting one of said plug members in each cavity of a plurality of blocks whereby said first and second flat end walls are substantially flush with top and bottom surfaces, respectively, of said cinder block, and said protruding portion extends outwardly from said cinder block approximately the height of a mortar joint, (3) providing block surfaces with mortar, (4) stacking successive blocks on one another to form said cinder block wall, and (5) moving the blocks laterally immediately after stacking as required to true up the outer surface of the block wall during construction, the flat end surfaces of each insert being in face to face relationship with the second flat end walls of adjacent inserts thereby permitting said lateral movement.

2. The method of claim 1 wherein said insulating plug member is formed by using a thermally insulating foamed synthetic resin having a thermal conductivity of less than 1.0 Btu/sq.ft./hr./°F./in.

3. The method of claim 2 wherein said resin is selected from the group consisting of an epoxy resin, phenolic resin, polyethylene, polystyrene, polyurethane, and polyvinyl chloride.

4. A block structure comprising, in combination, a cinder block having a pair of walled and generally rectangular spaces therein between a top and a bottom surface and, an insulating device received in each of said rectangular spaces, said device comprising an insulating plug member having a generally rectangular cross-section, first and second opposite flat end walls, and four side walls, each of which said side walls lies against a different wall of said rectangular space, an integral protruding portion extending from a first one of said end walls, and having a flat end surface, a cavity formed in said plug member and extending inwardly of one of said end walls and one of said side walls, thereby forming a grip area on the cinder block, each one of said plug members substantially filling one of said spaces, said first and second end walls being substantially flush with said top and bottom surfaces, respectively, of a cinder block said protruding flat end surface portion having a height equal to the height of the mortar joint, a cross-sectional dimension sufficient to fill a substantial portion of the space between adjacent block members, and a flat surface which is parallel throughout its extent to the second flat end wall so that stacked cinder blocks forming a wall may be moved laterally in any direction during the stacking operation to permit aligning the the exterior faces of the cinder blocks.

5. An insulating device for hollow masonry block comprising an insulating plug member having a generally rectangular cross-section with first and second opposite flat end walls and four side walls, the latter for engaging interior cinder block rectangular space sides, said flat end walls extending between said four side walls, an integral protruding portion extending outwardly from the first one of said flat end walls between about ¼ and about ½ inch, said protruding portion having a flat end surface of a dimension of approximately the same size as a cross-sectional dimension of said protruding portion for lying against the second flat end wall of an adjacent plug member and extending parallel to the second flat end wall whereby when the plug members are placed in the cavities of cinder blocks the flat end surface of one plug member may be placed in face to face contact with the flat end wall of an adjacent plug member, and the block having the first plug member may be moved laterally in all directions to align the other surfaces of the respective blocks, and a cavity formed in said plug member inwardly of one of said end walls and one of said side walls whereby when the plug members are placed in the cavities of cinder blocks hand holds are provided adjacent the cavities.

* * * * *